US006432216B1

(12) United States Patent
Thies

(10) Patent No.: US 6,432,216 B1
(45) Date of Patent: Aug. 13, 2002

(54) SOIL SENSING SYSTEM FOR A DISHWASHER

(75) Inventor: Edward L. Thies, Niles, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/500,851

(22) Filed: Feb. 9, 2000

(51) Int. Cl.[7] ..... B08B 3/00; B08B 3/04

(52) U.S. Cl. ..... 134/18; 134/25.2; 134/56 D; 134/57 D; 134/58 D; 134/104.1; 134/172

(58) Field of Search ..... 134/18, 25.2, 56 D, 134/57 D, 58 D, 104.1, 172

(56) References Cited

U.S. PATENT DOCUMENTS

| | | | | |
|---|---|---|---|---|
| 4,346,723 | A | 8/1982 | Geiger | 134/104 |
| 4,559,959 | A | 12/1985 | Meyers | 134/56 |
| 4,672,441 | A | 6/1987 | Mayers | 134/18 |
| 4,741,353 | A | 5/1988 | Milocco | 137/119 |
| 4,820,934 | A | 4/1989 | Marcade et al. | 307/41 |
| 5,165,433 | A | 11/1992 | Meyers | 134/104.4 |
| 5,205,304 | A | 4/1993 | Cooper et al. | 134/99.2 |
| 5,223,042 | A | 6/1993 | Milocco | 135/25.2 |
| 5,264,043 | A | 11/1993 | Milocco | 134/25.2 |
| 5,310,090 | A | 5/1994 | Taylor, Jr. | 222/129 |
| 5,486,090 | A | 1/1996 | Chung | 415/146 |
| 5,494,062 | A | 2/1996 | Springer | 134/58 |
| 5,577,399 | A | 11/1996 | Whipple | 68/12.02 |
| 5,730,805 | A | 3/1998 | Bertsch et al. | 134/10 |
| 5,752,533 | A | 5/1998 | Edwards | 134/176 |
| 5,839,454 | A | 11/1998 | Matz | 134/57 |
| 5,849,101 | A | 12/1998 | Edwards | 134/18 |
| 5,900,070 | A | 5/1999 | Jarvis et al. | 134/18 |
| 5,909,743 | A | 6/1999 | Thies | 134/10 |
| 5,924,432 | A | 7/1999 | Thies et al. | 134/56 |
| 5,924,433 | A | 7/1999 | Thies et al. | 134/200 |
| 6,182,674 | B1 * | 2/2001 | Jozwiak et al. | 134/56 |

* cited by examiner

*Primary Examiner*—Zeinab El-Arini
(74) *Attorney, Agent, or Firm*—Robert O. Rice; Andrea Powers Denklau; Joel M. Van Winkle

(57) ABSTRACT

A soil sensing system is provided for a dishwasher having an interior wash chamber receiving soiled dishes wherein during a wash cycle wash liquid is sprayed throughout the wash chamber through an upper wash arm and a lower wash arm and soils are collected in a soil collector. The soil collector includes a filter screen which is backwashed by the wash arm. A pressure sensor measures the pressure within the soil collector to provide an input which corresponds to the presence of soils. In order to improve the sensitivity of the pressure based soil sensing, the lower wash arm is deactivated. Deactivating the lower wash arm ceases the backflushing of the collection chamber's filter screen and allows pressure to build within the soil collector in the presence of only light or oily soils. A response is activated if the actual pressure within the collection chamber is greater than a predetermined limit pressure. The response may consist of the addition of heat to the water, the addition of time to the cycle, the draining of soiled wash liquid, the addition of detergent or possibly the addition of a wetting agent.

22 Claims, 4 Drawing Sheets

SOIL SENSING SYSTEM FOR A DISHWASHER

BACKGROUND OF THE INVENTION

1. Field of the Invention

The present invention relates to a dishwasher and more particularly, to a system for sensing light soil loads to allow an accurate cycle response thus improving washability and energy efficiency.

2. Description of Related Art

Domestic dishwashers in use today draw wash liquid from a sump at the bottom of a wash tub and spray the wash liquid within the wash tub to remove soils from dishes located on racks in the tub. It is well known that the removal of soils from the recirculating wash liquid positively impacts the wash performance of the dishwasher. Accordingly, to improve performance and efficiency, some dishwashers employ a system for separating soils out of the recirculating wash liquid wherein the soils are retained in a soil collector. Frequently, a filter screen is used to retain soil in the soil collector. For example, in U.S. Pat. No. 5,165,433, a dishwasher system is disclosed that includes a centrifugal soil separator which sends soil laden wash liquid into a soil container then wash liquid passes through a fine filter disposed in the wall of the soil container while soils are retained by the screen. Typically, backwash jets are directed against the filter by the lower wash arm in an attempt to clear the filter and prevent clogging.

U.S. Pat. No. 4,559,959 discloses a dishwasher wherein soil load is measured by monitoring pressure in a soil collector in which soils are retained after the wash liquid passes through a filter mesh. If the pressure exceeds a predetermined limit, indicating that the filter mesh is clogged, the wash liquid is completely purged by draining all of the wash liquid out of the tub and refilling the tub with fresh water. However, this dishwasher uses excess water and concerns over energy consumption have led to dishwashers utilizing purge systems that only partially drain the dishwasher tub. For example, U.S. Pat. No. 4,346,723 discloses a dishwashing system wherein soils are collected in a bypass soil collector and the soil collector may be purged by draining small amounts of wash liquid in spurts during an early wash period by selectively opening and closing a drain valve.

Since wash performance is effected by the soiled condition of the wash liquid recirculated through the system, all or a portion of the wash liquid may be drained from the dishwasher chamber if it is sensed that the soil collector has reached a predetermined pressure as disclosed in U.S. Pat. No. 5,900,070 and clean water can be introduced into the chamber. However, since the soil collector is usually provided with a screen that is backwashed, pressure only builds when there is a heavy soil load in the collector.

Wash performance in a dishwasher is also related to the temperature of the wash liquid. It is known that hot water is more effective for washing than cold water, particularly for oily soils, which melt at higher wash liquid temperatures. Accordingly, dishwashers are commonly connected to a hot water supply such that the fill water supplied into the dishwasher has a relatively high temperature. Thermal inputs during the dishwasher cycle typically occur during a thermal hold wherein the cycle of operation is interrupted while a heater is energized until a thermostat is satisfied or a maximum default time limit elapses. A dishwasher may have a pressure sensor for sensing fluid pressure within the soil collector such as is shown in U.S. Pat. No. 5,900,070.

A control means energizes a heater disposed in a sump region of the wash chamber when the pressure within the soil collector exceeds a predetermined limit pressure. Heat energy is then supplied to the wash liquid in response to the soil load.

Detergents and wetting agents can affect the wash performance in a dishwasher. Chemical energy can affect the breakdown of soils and thus the ability of the wash liquid to remove soils from dishes. It is well known that the use of detergents and wetting agents positively impacts wash performance, so varying amounts of detergents and wetting agents would be useful for varying soil loads. It would be beneficial if the amount of detergent and/or wetting agent added to the wash liquid was responsive to the soiled condition of the wash liquid.

Unfortunately, there is currently no means of measuring light soil loads. Pressure in the soil collector usually indicates the presence of heavy soil loads because the backwash provided by the lower wash arm keeps light soil loads from clogging the filter and thus, from increasing pressure in the collection chamber.

Accordingly, it would be an improvement in the art if a dishwasher wash system was provided which could sense light soil loads in the dishwasher so a response could be initiated, for example, the addition of heat to the water, the addition of time to the cycle, the draining of soiled wash liquid or the addition of detergent.

SUMMARY OF THE INVENTION

The present invention is directed to an automatic dishwasher wash system that is responsive to the presence of light or oily soil loads. It is an object of the invention to provide a dishwasher having an interior wash chamber for receiving wash liquid and a sump region disposed at the bottom of the wash chamber. A wash pump is disposed in the sump region and has an intake through which wash liquid is drawn from the sump. The wash pump has a main outlet and a secondary outlet. The dishwasher draws wash liquid through the sump region into the wash pump intake and selectively directs wash liquid from the wash pump main outlet to the wash arm. Wash liquid is directed from the wash pump secondary outlet to a soil collector having a filter screen along the top portion. Wash liquid is sprayed from the wash arm through at least one jet toward the filter when the wash liquid is directed to the wash arm. A valve is provided for selectively deactivating wash liquid to the lower wash arm such that when the valve is open in a first position wash liquid flows to the wash arm and when the valve is closed in a second position wash liquid is prevented from flowing to the wash arm. The wash liquid can be diverted to an upper wash arm when the valve is in the second position. A pressure sensor senses soils in the soil collector. The pressure within the soil collector is monitored when the wash liquid is not directed through the wash arm to backwash the filter screen. If the pressure measurement exceeds a predetermined limit, a response is activated For example, it is an object of the invention to provide a response of energizing a heater disposed in the sump region for increasing wash liquid temperature if the pressure sensor exceeds a predetermined limit.

It is a further object of the invention to provide a response of adding a wetting agent into the wash chamber.

It is an object of the invention to provide a response of adding detergent into the wash chamber.

Further, it is an object of the invention to provide a response of adding wash liquid to the wash chamber to help rinse soils away.

It is an object of the invention to provide a response of partial or complete draining of wash liquid from the wash chamber and the addition of fresh wash liquid if the pressure sensor exceeds a predetermined limit.

It is a further object of the invention to provide a dishwasher that operates with a cleaning cycle having a fill period and a wash period. The length of the wash period time can be increased if the pressure sensor exceeds a predetermined limit.

DESCRIPTION OF THE PREFERRED EMBODIMENT

The basic constructional features of the drain pump system of the present invention are disclosed in U.S. patent application Ser. No. 09/326,280 to Jozwiak et al., entitled "Automatic Purge Filtration System for a Dishwasher", herein incorporated by reference. In this patent application, the operation of a drain pump system for purging wash liquid is fully explained.

Figure 1:
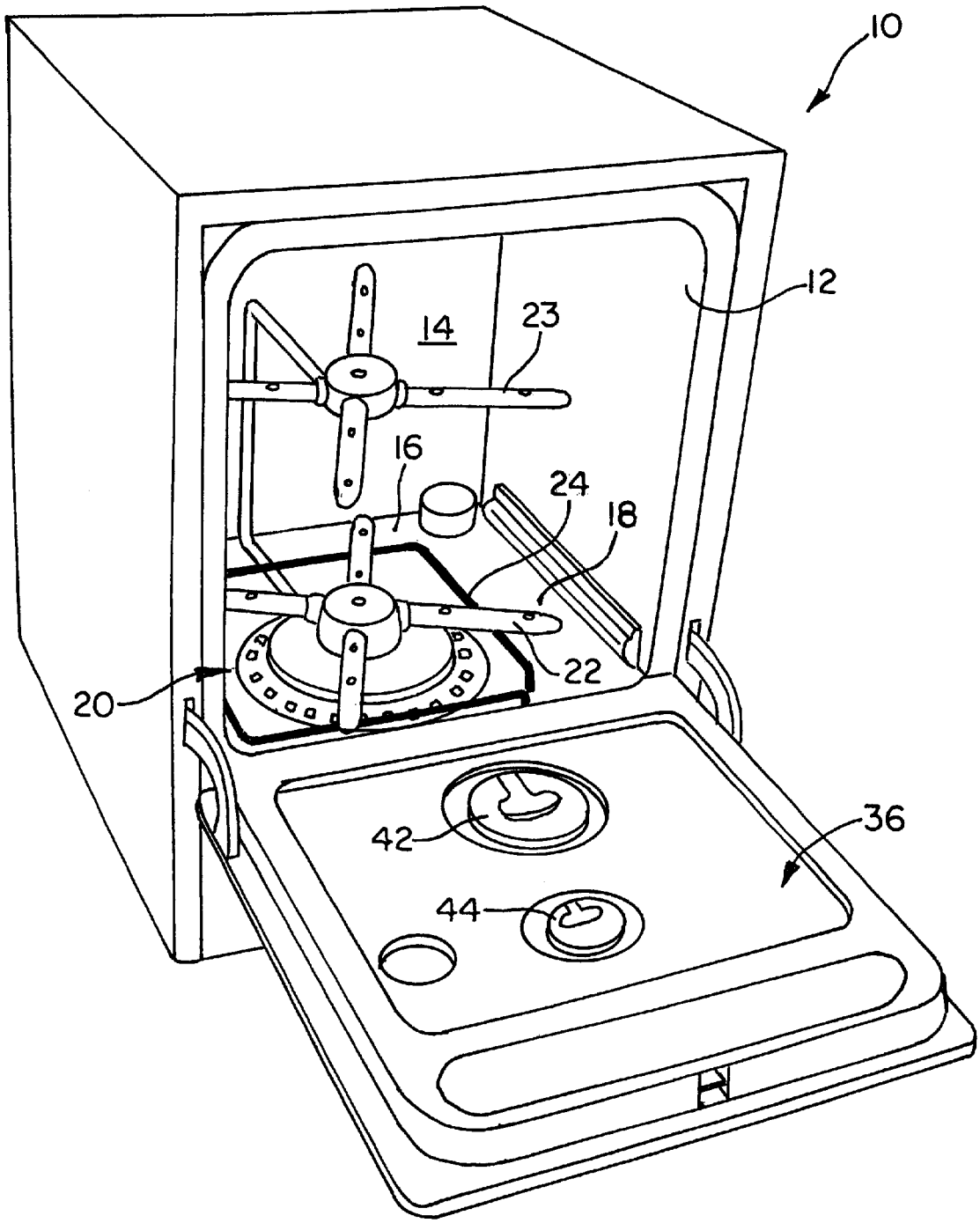
FIG. 1 is a perspective view of a dishwasher including a soil sensing system in accordance with the present invention.

FIG. 1 illustrates an automatic dishwasher 10 providing the environment of the invention. The dishwasher 10 includes an interior tub 12 forming an interior wash chamber or dishwashing space 14. The tub 12 includes a sloped bottom wall 16 that defines a lower tub region or sump 18 of the tub. A soil collector and wash pump assembly 20 are centrally located in the bottom wall 16 and a lower wash arm assembly 22 extends upwardly from a portion thereof and an upper wash arm assembly 23 is positioned above the lower wash arm assembly. A heating element 24 may be disposed within the lower portion of the dishwashing space 14 and may be operated to heat wash liquid within the dishwasher 10. The tub includes a door 36 that defines one of the walls of the tub. One or more dispensers 42 and 44 may be disposed along the door 36 for dispensing detergent and/or wetting agent within the wash chamber.

Figure 2:
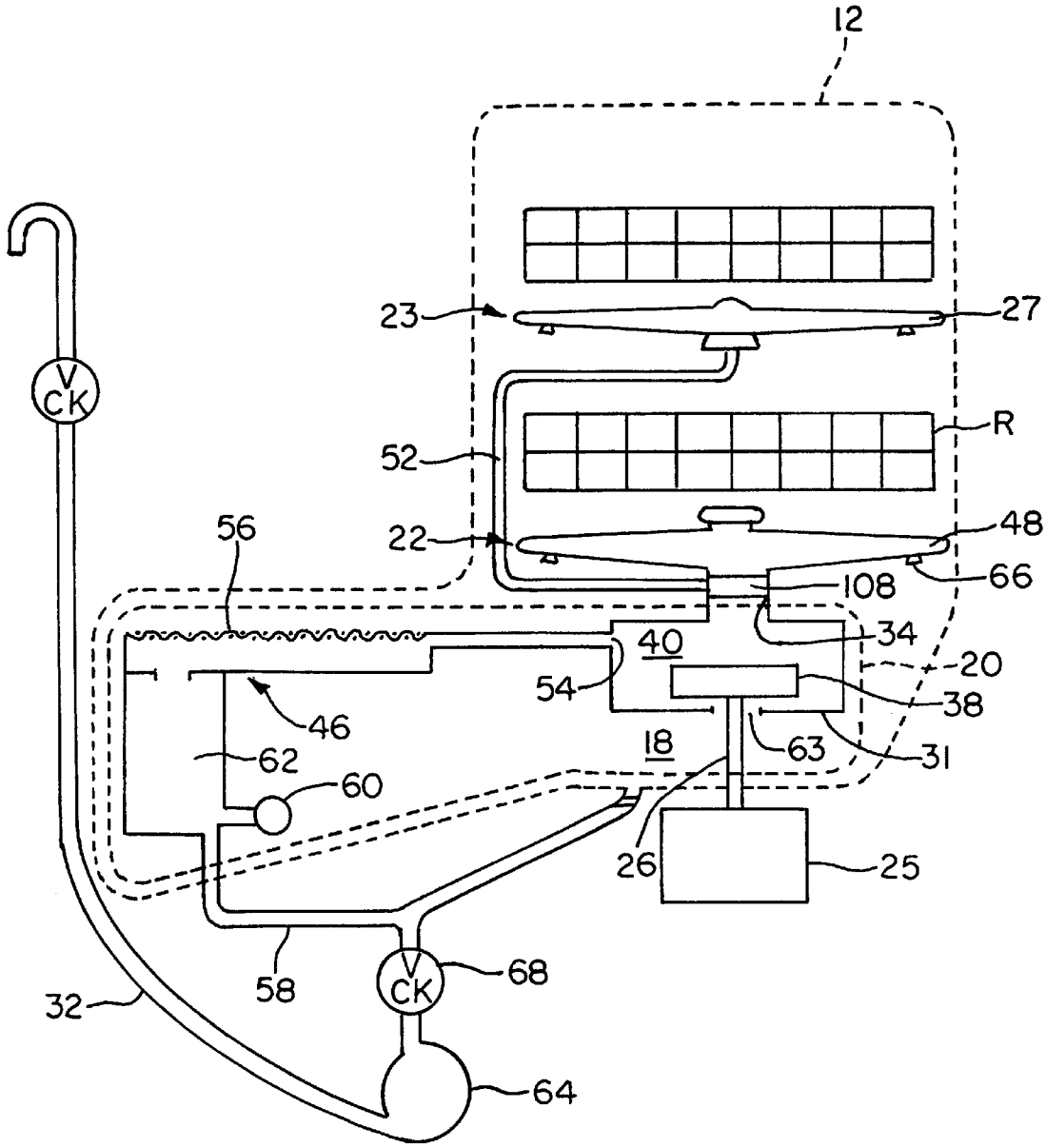
FIG. 2 is a schematic illustration of the dishwasher pump and soil collector used in the dishwashing system illustrated in FIG. 1.

As illustrated in FIG. 2, the soil collector and wash pump assembly 20 include a motor 25 suspended below the tub 12. A pump chamber 40 is supported within the sump region and houses a wash pump 31 having a wash impeller 38. The motor has an output shaft 26 that extends up through the base to drivingly connect the wash impeller 38. An annular soil collector, or soil separator, 46 is disposed about the pump chamber 40.

During the wash mode, the wash impeller 38, driven by motor 25, draws wash liquid from the sump 18 through a pump inlet 63, into the pump chamber and pressurizes the wash liquid within the pump chamber 40. The majority of the pressurized wash liquid is directed by diffuser vanes (not shown) through the pump outlet 34. The pump outlet 34 guides wash liquid to the lower wash arm assembly 22 and to an upper wash arm supply tube 52. A valve 108 may be provided at the pump outlet to selectively direct wash liquid to the lower and upper wash arms. Wash liquid is repeatedly recirculated over the dishes for removing soils.

A portion of wash liquid within the pump chamber 40 is directed to a secondary outlet 54 and from there into the soil collector 46. Wash liquid flows from the pump chamber 40 into the soil collector 46. Fine mesh filter segments 56 are positioned along the top of the soil collector and permit flow of cleansed wash liquid to exit from the soil collector 46 and return to the dishwasher sump region 18. In this manner, soils are captured within the soil collector 46.

During the wash mode, the filter segments 56 are repeatedly backflushed. The lower wash arm assembly 22 has a lower wash arm 48 extending outwardly above the soil collector. The wash arm 48 rotates as pressurized wash liquid is emitted from downwardly directed jets 66. Means may be provided for forming a fan-shaped spray from the flow of wash liquid through the jets 66. As the lower wash arm 48 rotates, this fan shaped spray sweeps across the filter segments 56 providing a backwashing action to keep the filter screen segments 56 clear of soil particles which may impede the flow of cleansed wash liquid into the sump 18.

In spite of backflushing, in conditions of a heavy soil load, the filter screen segments 56 may become clogged with food soils. When this occurs, pressure within the soil collector 46 increases. This pressure increase is sensed by a pressure sensor 60 which may be connected to a pressure dome or chamber via a pressure tap tube. The pressure sensor 60 can be either an analog device or a digital device. As the pressure within the soil collector 46 rises, the air within the pressure dome 62 is compressed and this increase in air pressure is sensed by the pressure sensor 60. The pressure sensor 60 may be a single-pole, single throw pressure switch which is designed to trip or actuate at a predetermined limit pressure $P_L$ or possibly it could be an analog pressure sensor. The pressure sensor 60 may be mounted to any suitable structure beneath the bottom wall 16 of the dishwasher.

When the actual pressure $P_A$ in the soil collector exceeds the predetermined limit pressure $P_L$, indicative of a clogged screen mesh 56, a response R can be activated. The response may include a partial or complete drain of the wash liquid, or possibly an increase in the thermal input. As described in U.S. Pat. Nos. 5,900,070 and 5,909,743, these responses facilitate the wash process when there is a heavily soiled load.

Detecting the presence of light or oily soils is difficult to accomplish with the above-described system due to the effectiveness of the filter backflushing. When just a light soil load is present, the backflushing of the filter screens 56 keeps the lighter soils from clogging the filter and thus from increasing the pressure within the soil collector 46. A pressure reading within the soil collector may not exceed the pressure limit $P_L$ because pressure does not have an opportunity to build when the light and oily soils arc being backflushed.

In the present dishwasher system, through operation of the valve 108, the lower wash arm 48 may be periodically deactivated; thus the backflushing action of the filter screens 56 will be discontinued. This allows pressure to build within the soil collector 46 when there is only a light or oily soil presence. The pressure can be measured during this lower wash arm 48 "off period" and a response R activated if the actual pressure $P_A$ is greater than the light pressure limit $P_L$. This dishwasher system allows the pressure limit $P_L$ to be set relatively low so a response R can be initiated accordingly. The system also contemplates deactivating the lower wash arm 48 at defined times during the wash cycle to measure soils that are prevalent at different times. For example, the lower wash arm 48 may be deactivated when the wash liquid is at a lower temperature, perhaps less than 130 degrees F, to determine if soils exist that are difficult to remove at lower temperatures. It will be appreciated that the timing of the "off period" can be set to learn about the characteristics of the soils present. Thus, the washability of the dishwasher 10 is improved.

The lower wash arm 48 may be deactivated by the valve 108 that may be configured such that when the valve 108 is open in a first position wash liquid flows to the lower wash arm 48 and when the valve 108 is closed in a second position wash liquid is diverted to the upper wash arm assembly 23. The upper wash arm assembly 23 has an upper wash arm 27 for spraying wash liquid on dishes within the wash chamber 14. The valve 108 may be constructed such that wash liquid flows through the pump outlet 34 to both the upper and lower wash arms when the lower wash arm is activated or wash liquid may selectively flow between the upper 27 and lower 48 wash arms in an alternating fashion. If an alternating wash arm operation is implemented, the pressure within the soil collector 46 is measured when the lower wash arm 48 is deactivated. The measurement can be timed to occur when the wash liquid is being supplied to the upper wash arm 27.

There are many configurations allowing wash liquid to alternate between the lower and upper spray arms or wherein the lower wash arm 48 may be deactivated by selectively diverting the flow of wash liquid to the upper wash arm. For example, U.S. Pat. No. 5,924,432, incorporated by reference herein, discloses a dishwasher utilizing a valve that selectively directs the flow of wash liquid between the upper and lower spray arms. Additionally, U.S. Pat. Nos. 5,752,533; 5,486,089; 5,924,432; 4,741,353 and 5,264,043 disclose configurations allowing wash liquid to alternate between multiple spray arms. The present invention may be found in a dishwasher in which the flow of wash liquid alternates between the upper and lower spray arms. This allows the actual pressure measurement to be taken during the period when the upper wash arm is activated and the lower wash arm is deactivated.

Besides the many configurations for allowing wash liquid to alternate between spray arms, there are other means of selectively stopping the backwash of the filter screen so light soils can be sensed. For example, the dishwasher 10 may have two lower spray arms, a rotating flush arm above the screen for flushing soils from an underside of the screen and a wash water arm above the flush arm for spraying dishes in the chamber 14. Thus, the wash water arm can be flow separated from the flush water arm for selective operation. This configuration is detailed in U.S. Pat. No. 5,730,805, incorporated by reference herein.

Another means of selectively controlling the backwash action is achieved in wash arms having individual controls for the backwash jets, or nozzles. The lower wash arm is constructed with two separate inlets to two chambers within the wash arm. The upper chamber is used for spraying dishes and the lower chamber is used to backwash the filter screen. This configuration allows selective fluid control to the lower chamber and thus intermittent operation of the backwash jets.

Additionally, the dishwasher system might be constructed with individually controlled backwash jets. In this manner, the flow of liquid can be selectively controlled. Not only can each jet be selectively turned off and on, but also the force of the spray emitting from the jet can be used to control the effect of the jet.

The dishwasher system can either provide for a pressure measurement to be taken within the soil collector 46 during the lower wash arm "off period", or both at a time when the screen filters 56 are being backflushed and during the "off period". Providing different circumstances under which pressure measurements are taken allows for different responses R to be initiated in response to different pressure limits $P_L$.

Once the lower wash arm has been deactivated, the actual pressure $P_A$ within the soil collector 46 can be measured immediately or after a defined period of time T. A time period T can be set to allow pressure to build within the soil collector during the "off period". If the actual pressure $P_A$ exceeds the predetermined pressure limit $P_L$, a first response R1 is activated. The response may consist of a partial drain of wash liquid with the addition of some clean liquid $R_a$; the complete drain of wash liquid with a fresh fill of liquid $R_b$; the addition of heat to the wash liquid $R_c$; the addition of detergent to the wash liquid $R_d$; the addition of a wetting agent to the wash liquid $R_e$; or possibly the addition of time to the wash cycle $R_f$.

Figure 3:
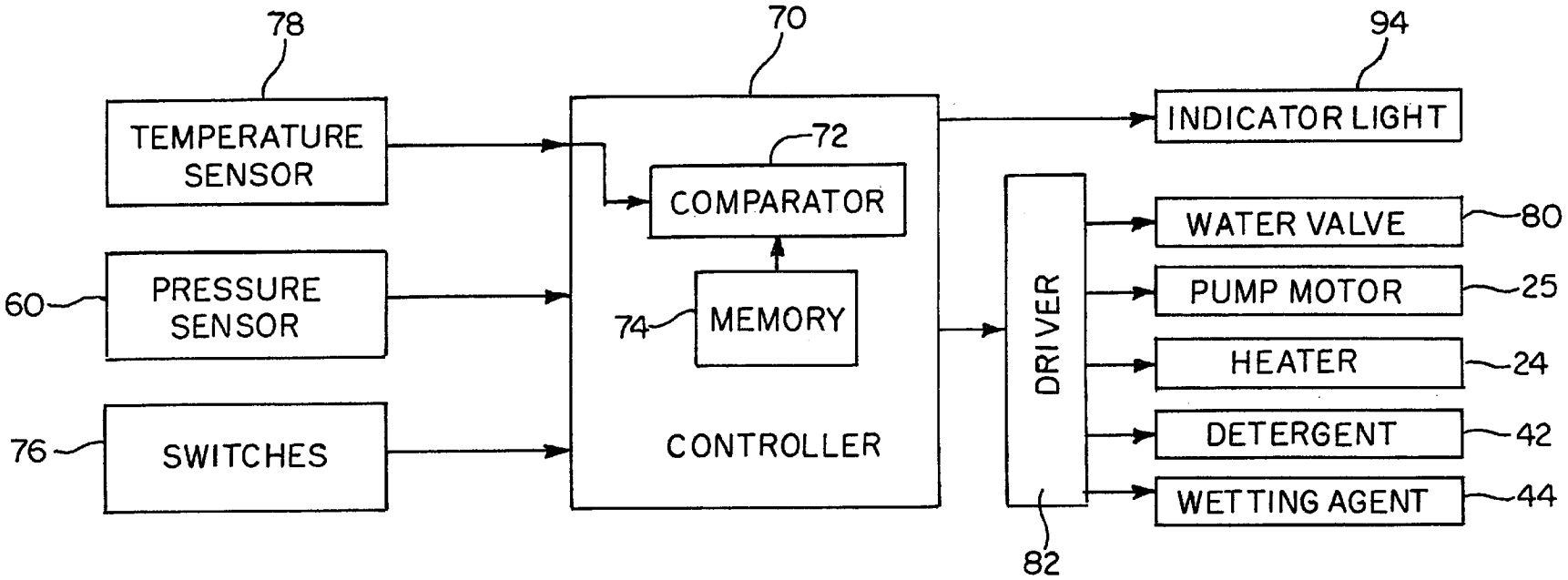
FIG. 3 is a block diagram of the control elements for an electrical system used in the dishwashing system illustrated in FIG. 1.
Figure 4:
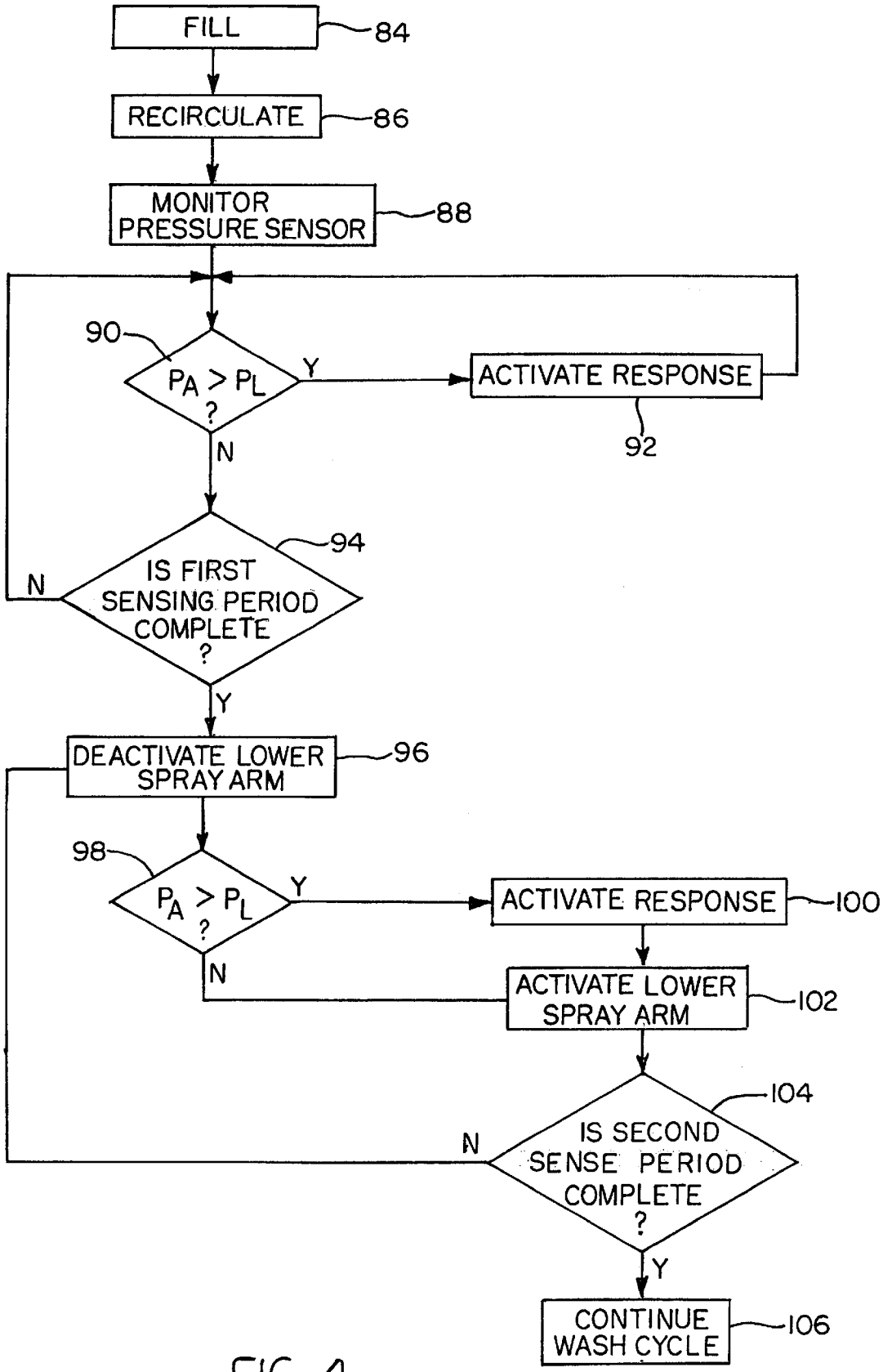
FIG. 4 is a flow chart showing the operation of a dishwasher according to the present invention.

Turning now to FIGS. 3 and 4, the operation of the dishwasher can be explained. Step 84 represents a conventional fill period wherein a fill valve 80 is energized for supplying water into the dishwasher. After water is added to the dishwasher, the motor 25 is energized for recirculating wash liquid throughout the dishwasher in a wash or recirculation mode as shown in step 86. After fill liquid is initially supplied into the tub 12, the wash pump 31 is energized. During the wash mode, there may be instances of monitoring pressure within the soil collector, as represented by step 88. There, may be a first sensing period, as shown in step 90, as the lower wash arm 48 operates to clean dishes on the lower rack and the jets 66 backwash the filter 56. If the pressure sensor 60 provides a signal to the controller 70 indicating that the pressure within the soil collector exceeds a predetermined limit $P_L$, then a response is activated, as shown in step 92. Typically, that response will be a purging of the soil collector as described above.

Either at a fixed time, represented by step 94, or at a time when the pressure sensor 60 no longer senses any heavy soil loads, most of the wash liquid is diverted to the upper wash arm 27 thus ceasing the backwash of the filter screens 56 as the lower wash arm 48 is deactivated in step 96. There is then a second sensing period 98 wherein the controller 70 monitors the pressure sensor 60 to determine whether the actual pressure $P_A$ exceeds the predetermined limit pressure $P_L$ within the soil collector 46. If the actual pressure exceeds the limit pressure, then a response R is activated, as represented in step 100. The response may be any of the responses $R_a$–$R_f$ discussed below and the dishwasher system may be configured to respond with one or more of the responses $R_a$–$R_f$. Either before or after the response R has been completed, the lower wash arm 48 is reactivated in step 102 and it is determined whether the second sense period is complete, shown in step 104. If the second sense period is complete, the wash cycle continues as represented in step 106.

As will be appreciated, the complete dishwasher cycle may include additional steps such as rinsing and drying. During any of the sensing periods, an indicator light 94 (FIG. 3), such as an LED, can be energized to provide feedback to the consumer that a soil sensing operation is being executed.

It should be understood that the present invention may contemplate initiating a plurality of responses. For example, after a first response R is initiated, if during subsequent sensing, the actual pressure $P_A$ in the soil collector 46 exceeds the predetermnined limit pressure $P_L$, then a second response R2 is initiated. This response R2 may either be the same response as the first response R1 or a different response. This dishwasher system of measuring the pressure in the soil collector 46 when the lower wash arm 48 is deactivated may occur a defined number of times during the wash process or may continue until the pressure measurement indicates the actual pressure $P_A$ is less than the predetermined pressure limit $P_L$.

If the response R is either a partial drain of wash liquid with the addition of some clean liquid $R_a$ or the complete drain of wash liquid with a fresh fill of liquid $R_b$, a drain pump 64 is energized to clear the filter screen segments 56, as represented in FIG. 2. The drain pump draws wash liquid, concentrated with soils, from the soil collector 46 through a drain conduit 58 and pumps it past a check valve 68 through a drain hose 32 to drain. If only partially drained, the amount of wash liquid drained may be controlled by time or by other means such as draining until the pressure within the soil collector 46 drops below the predetermined pressure limit $P_L$.

In this manner, the soil collector 46 of the present invention is purged of soils and fresh wash liquid can be introduced through the water valve 80 (FIG. 3). It can be understood, moreover, that since the drain pump 64 is separate from the wash pump 31, the purging of soils from the soil collector 46 can be accomplished while the wash pump impeller 38 continues to recirculate wash liquid through the dishwashing chamber 14.

If the response is the addition of heat to the wash liquid $R_c$ to increase the thermal input into the dishwasher, a control system can be provided for implementing a thermal hold in response to the soil level. For example, as shown in FIG. 3, a controller 70 may be provided comprising a comparator 72 and memory means 74. The controller 70 may be an electromechanical sensor or a microprocessor connected to operation switches 76 such that the dishwasher operator can input cycle selections. The controller 70 also receives input from the pressure sensor 60 and from a temperature sensor 78 which may be mounted adjacent the dishwasher bottom wall 16 for sensing the temperature of wash liquid within the dishwasher. Alternatively, the temperature sensor 78 may be attached to a base plate which forms part of the tub or may be attached to the tub and have a sensing portion protruding through a hole in the base plate for directly sensing the temperature of the wash water in the dishwasher sump 18. The temperature sensor may be a thermistor or a thermostat. A water valve 80 for supplying water into the dishwasher, the pump motor 25 and the heater 24 are connected to the controller 70 through a driver 82 such that these components can be selectively energized by the controller 70. A system for increasing the thermal input in the dishwasher is explained in detail in U.S. Pat. No. 5,900,070, incorporated by reference herein.

If the response is the addition of detergent $R_d$ or a wetting agent $R_e$ to the wash liquid to increase the chemical input into the dishwasher, a control system can be provided for releasing detergent and/or wetting agent in incremental amounts. As illustrated in FIG. 3, a detergent dispenser 42 and a wetting agent dispenser 44 are connected to the controller 70 through a driver 82 such that these dispensers can be selectively energized by the controller. For example, the dispensers may be of the type disclosed in U.S. Pat. Nos. 4,820, 934; 5,205,304; or 5,839,454.

While the above description includes two sensing periods, it can be readily understood that the present invention is not limited to two sensing periods. The dishwasher cycle could be configured having one or more sensing periods. If the sensing period occurs more than once, there may be more than one response activated. The responses may be either the same response or different responses. For example, the first response R1 may be a partial drain of wash liquid $R_a$ and the second response R2 may be the addition of heat to the wash liquid $R_c$.

It will be understood that the system contemplates any response that increases wash performance of the dishwasher. For example, the responses $R_a$–$R_f$ are meant to be illustrative and not limiting. Additionally, it will be understood that there are different ways of draining wash liquid, adding detergents and/or wetting agents and heating wash liquid. For example, the process of completely draining the tub can be effected similarly to the method disclosed in U.S. Pat. No. 4,559,959, incorporated by reference herein. The process of partially draining the tub can be effected similarly to the method disclosed in U.S. Pat. No. 5,223,042, incorporated by reference herein. The addition of detergents and/or wetting agents can be effected by providing a dispenser 42 or 44 within the tub or perhaps on the inside wall of the door and signaling the dispenser to release a portion of the detergent and/or wetting agent in response to the sensor measurement. The process of heating the wash liquid can be effected similarly to the method disclosed in U.S. Pat. No. 5,900,070, incorporated by reference herein.

It can be seen, therefore, that the present invention provides a system for improving the washability of a dishwasher while minimizing energy consumption. It is possible to respond to light soils loads with an appropriate response to ensure a clean load of dishes. While the present invention has been described with reference to the above described embodiments, those of skill in the art will recognize that changes may be made thereto without departing from the scope of the invention as set forth in the appended claims.

I claim:

1. A method of sensing soils in an automatic dishwasher having an interior wash chamber for receiving wash liquid and a sump region disposed at the bottom of the wash chamber, a wash pump disposed in the sump region and having an intake through which wash liquid is drawn from the sump, the wash pump having a main outlet and a secondary outlet, and a lower wash arm that receives wash liquid from the main outlet, the method comprising the steps of:

drawing wash liquid through the sump region into the wash pump intake;

selectively directing wash liquid from the wash pump main outlet to the lower wash arm;

directing wash liquid from the wash pump secondary outlet to a soil collector;

collecting soils in the soil collector having a filter;

spraying wash liquid from the lower wash arm through at least one jet and toward the filter when the wash liquid is directed to the lower wash arm;

disabling the lower wash arm to discontinue the flow of wash liquid to the lower wash arm; and sensing soils in the soil collector with a pressure sensor when the wash liquid is not directed to the lower wash arm.

2. The method of claim 1 further comprising the step of:

activating a response if the pressure sensed by the pressure sensor exceeds a predetermined limit.

3. The method of claim 1 further comprising the step of:

energizing a heater disposed in the sump region to increase wash liquid temperature if the pressure sensed by the pressure sensor exceeds a predetermined limit.

4. The method of claim 1 further comprising the step of:

dispensing a wetting agent into the wash chamber if the pressure sensed by the pressure sensor exceeds a predetermined limit.

5. The method of claim 1 further comprising the step of:

adding wash liquid to the wash chamber if the pressure sensed by the pressure sensor exceeds a predetermined limit.

6. The method of claim 1 further comprising the step of:

draining wash liquid from the wash chamber; and adding wash liquid to the wash chamber if the pressure sensed by the pressure sensor exceeds a predetermined limit.

7. The method of claim 1 further comprising the step of:

dispensing a detergent into the wash chamber if the pressure sensed by the pressure sensor exceeds a predetermined limit.

8. The method of claim 1 wherein the steps of claim 1 are part of a cleaning cycle having a fill period and a wash period, said method further comprising the step of:

increasing the wash period if the pressure sensed by the pressure sensor exceeds a predetermined limit.

9. The method of claim 1 wherein the wash liquid is selectively directed to the wash arm by a valve.

10. The method of claim 9 wherein the valve is open in a first position allowing wash liquid to flow to the lower wash arm and is closed in a second position preventing wash liquid from flowing to the lower wash arm.

11. The method of claim 10 wherein the valve is disposed within the wash pump.

12. The method of claim 10 further comprising the step of:

directing wash liquid to an upper wash arm supply tube when the valve is in the second position.

13. A method of sensing soils in an automatic dishwasher having an interior wash chamber for receiving wash liquid and a sump region disposed at the bottom of the wash chamber, a wash pump disposed in the sump region and having an intake through which wash liquid is drawn from the sump, the wash pump having a first outlet and a second outlet, and a lower wash arm and an upper wash arm operatively connected to the first outlet, the method comprising the steps of:

drawing wash liquid through the sump region into the wash pump intake;

directing wash liquid from the wash pump second outlet to a soil collector;

collecting soils in the soil collector having a filter;

selectively directing wash liquid from the wash pump first outlet to the lower wash arm and the upper wash arm;

selectively directing wash liquid from the wash pump first outlet to the lower wash arm;

spraying wash liquid from the lower wash arm through at least one jet and toward the filter when the wash liquid is directed to the lower wash arm;

selectively directing wash liquid from the wash pump first outlet to the upper wash arm thereby disabling the lower wash arm;

sensing soils in the soil collector with a pressure sensor when the lower wash arm is disabled;

comparing the soil pressure in the soil collector to a predetermined limit pressure;

activating a response if the soil pressure in the soil collector exceeds the limit pressure; and enabling the lower spray arm.

14. A method of sensing soils in an automatic dishwasher having an interior wash chamber for receiving wash liquid and a sump region disposed at the bottom of the wash chamber, a wash pump disposed in the sump region and having an intake through which wash liquid is drawn from the sump, the wash pump having a first outlet and a second outlet, and a backwash device that receives wash liquid from the First outlet, the method comprising the steps of:

drawing wash liquid through the sump region into the wash pump intake;

selectively directing wash liquid from the wash pump first outlet to the backwash device;

directing wash liquid from the wash pump second outlet to a soil collector;

collecting soils in the soil collector having a filter;

spraying wash liquid from the backwash device and toward the filter when the wash liquid is directed to the backwash device;

disabling the backwash device to discontinue the flow of wash liquid to the backwash device; and sensing soils in the soil collector with a pressure sensor when the wash liquid is not directed to the backwash device.

15. The method of claim 14 further comprising the step of:

activating a response if the pressure sensed by the pressure sensor exceeds a predetermined limit.

16. The method of claim 14 further comprising the step of:

energizing a heater disposed in the sump region to increase wash liquid temperature if the pressure sensed by the pressure sensor exceeds a predetermined limit.

17. The method of claim 14 further comprising the step of:

dispensing a wetting agent into the wash chamber if the pressure sensed by the pressure sensor exceeds a predetermined limit.

18. The method of claim 14 further comprising the step of:

adding wash liquid to the wash chamber if the pressure sensed by the pressure sensor exceeds a predetermined limit.

19. The method of claim 14 further comprising the step of:

draining wash liquid from the wash chamber; and adding wash liquid to the wash chamber if the pressure sensed by the pressure sensor exceeds a predetermined limit.

20. The method of claim 14 further comprising the step of:

dispensing a detergent into the wash chamber if the pressure sensed by the pressure sensor exceeds a predetermined limit.

21. The method of claim 14 wherein the steps of claim 14 are part of a cleaning cycle having a fill period and a wash period, said method further comprising the step of:

increasing the wash period if the pressure sensed by the pressure sensor exceeds a predetermined limit.

22. The method of claim 14 wherein the backwash device has a jet and the jet is disabled to discontinue the flow of wash liquid to the filter.

* * * * *